US009533845B2

(12) United States Patent
Mueller et al.

(10) Patent No.: US 9,533,845 B2
(45) Date of Patent: Jan. 3, 2017

(54) METHOD AND DEVICE FOR COMBINING AN AUXILIARY STACK AND A MAIN STACK, SHEET-FED PRINTING PRESS OR SHEET PUNCHING MACHINE AND METHOD FOR DRIVING AN AUXILIARY STACK CARRIER

(71) Applicant: HEIDELBERGER DRUCKMASCHINEN AG, Heidelberg (DE)

(72) Inventors: Andreas Mueller, Heidelberg (DE); Georg Grasmueck, Niederkirchen (DE); Manfred Haeussler, Karlsruhe (DE); Jens Kloss, Eppelheim (DE); Burkhard Wolf, Dossenheim (DE); Johannes Schubert, Wiesloch-Baiertal (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/856,779

(22) Filed: Sep. 17, 2015

(65) Prior Publication Data

US 2016/0075527 A1 Mar. 17, 2016

(30) Foreign Application Priority Data

Sep. 17, 2014 (DE) ..... 10 2014 013 688

(51) Int. Cl.
*B65H 1/26* (2006.01)

(52) U.S. Cl.
CPC ..... *B65H 1/263* (2013.01); *B65H 2301/42256* (2013.01); *B65H 2403/00* (2013.01); *B65H 2601/252* (2013.01); *B65H 2801/21* (2013.01)

(58) Field of Classification Search
CPC ..... B65H 1/26; B65H 1/263; B65H 3/32
USPC ..... 271/157, 158; 414/795.8
See application file for complete search history.

(56) References Cited

U.S. PATENT DOCUMENTS

| | | | | |
|---|---|---|---|---|
| 5,011,126 | A | 4/1991 | Suzuki et al. | |
| 5,529,456 | A * | 6/1996 | Luxem | B65H 1/26 271/158 |
| 5,538,238 | A * | 7/1996 | Filsinger | B65H 1/26 271/158 |
| 7,748,702 | B2 | 7/2010 | Auer et al. | |
| 2004/0262834 | A1* | 12/2004 | Bantlin | B65H 1/263 271/157 |
| 2005/0218583 | A1* | 10/2005 | Bantlin | B65H 1/263 271/121 |
| 2006/0244201 | A1* | 11/2006 | Diem | B65H 1/20 271/145 |

(Continued)

FOREIGN PATENT DOCUMENTS

| | | |
|---|---|---|
| DE | 4203500 A1 | 8/1993 |
| DE | 4421487 C1 | 5/1995 |

(Continued)

*Primary Examiner* — David H Bollinger
(74) *Attorney, Agent, or Firm* — Laurence A. Greenberg; Werner H. Stemer; Ralph E. Locher

(57) ABSTRACT

A method and a device for combining an auxiliary stack and a main stack include a rake carrying the auxiliary stack and being abruptly movable out of a stack area to prevent sheets that contact the rake from being entrained and to preserve the structure of the stack. A sheet-fed printing press or sheet punching machine having the device is also provided.

10 Claims, 4 Drawing Sheets

(56) References Cited

U.S. PATENT DOCUMENTS

| | | | | |
|---|---|---|---|---|
| 2007/0096388 | A1* | 5/2007 | Auer | B65H 1/26<br>271/157 |

FOREIGN PATENT DOCUMENTS

| | | | |
|---|---|---|---|
| DE | 3931710 | C2 | 6/1995 |
| DE | 29610103 | U1 | 8/1996 |
| DE | 19738029 | A1 | 3/1999 |
| DE | 3922803 | B4 | 9/2005 |
| DE | 102005019511 | A1 | 11/2006 |
| DE | 102006046823 | A1 | 5/2007 |
| DE | 102006021213 | A1 | 11/2007 |
| DE | 102010053587 | A1 | 6/2012 |

* cited by examiner

METHOD AND DEVICE FOR COMBINING AN AUXILIARY STACK AND A MAIN STACK, SHEET-FED PRINTING PRESS OR SHEET PUNCHING MACHINE AND METHOD FOR DRIVING AN AUXILIARY STACK CARRIER

CROSS-REFERENCE TO RELATED APPLICATION

This application claims the priority, under 35 U.S.C. §119, of German Patent Application DE 10 2014 013 688.4, filed Sep. 17, 2014; the prior application is herewith incorporated by reference in its entirety.

BACKGROUND OF THE INVENTION

Field of the Invention

The invention relates to a method and a device for combining an auxiliary stack and a main stack during non-stop operation of a feeder in a machine for processing sheets. The invention also relates to a sheet-fed printing press or sheet punching machine having the device.

When an auxiliary stack that is temporarily supported by an auxiliary stack carrier such as a rake is to be merged or combined with a main stack, the auxiliary stack carrier needs to be withdrawn from the stack area. Frictional forces between the sheets that are in contact with the stack carrier may cause those sheets to be pulled out together with the stack carrier or to develop creases, which may impede further processing. Those sheets then have to be removed from the stack area by hand.

German Patent DE 39 22 803 B4, corresponding to U.S. Pat. No. 5,011,126, discloses two auxiliary stack carriers disposed opposite one another and embodied as rakes. The auxiliary stack carriers are laterally movable into the stack area. During a withdrawal the forces acting on the sheets are supposed to cancel one another so that the positions of the sheets remain unchanged.

German Patent Application DE 10 2010 053 587 A1 discloses an auxiliary stack carrier that includes two endless movable belts guided by deflection rollers. When the auxiliary stack carrier is withdrawn from the stack area, a relative speed between the belts and the sheets in contact therewith is zero, so that the positions of the sheets remain unchanged.

German Patent Application DE 10 2005 019 511 A1 illustrates an auxiliary stack carrier including a blower device. The blower device is intended to create an air cushion so that a frictional force acting on the sheets due to the auxiliary stack carrier is minimized.

SUMMARY OF THE INVENTION

It is accordingly an object of the invention to provide an alternative method and device for combining an auxiliary stack and a main stack, which overcome the hereinaforementioned disadvantages of the heretofore-known methods and devices of this general type and which prevent sheets from entraining sheets when an auxiliary stack carrier is withdrawn from a stack area.

With the foregoing and other objects in view there is provided, in accordance with the invention, a device for supporting an auxiliary stack with an auxiliary stack carrier for combining the auxiliary stack with a main stack by pulling the auxiliary stack carrier out of a stack area with a drive for moving the auxiliary stack carrier. The auxiliary stack carrier has a jolting unit for pulling the auxiliary stack carrier out of the stack area in an abruptly accelerated way.

With the objects of the invention in view, there is furthermore provided a sheet-fed printing press or sheet-fed die-cutting or stamping machine, comprising a device according to the invention.

With the objects of the invention in view, there is also provided a method for driving an auxiliary stack carrier as it is pulled out of a stack area to combine an auxiliary stack and a main stack, which comprises imparting a jolt to the auxiliary stack carrier by using a pneumatically drivable jolting unit. The jolt causes the auxiliary stack carrier to experience a rapid acceleration, and the auxiliary stack carrier is subsequently moved out of the stack area at a constant speed by using a drive.

With the objects of the invention in view, there is concomitantly provided a method for driving an auxiliary stack carrier as it is pulled out of a stack area to combine or merge an auxiliary stack and a main stack, which comprises imparting successive sudden movements to the auxiliary stack carrier at regular intervals by using an electromechanically drivable jolting unit. The successive sudden movements cause the auxiliary stack carrier to be accelerated in a jerky or sudden or abrupt way as it is being pulled out of the stack area, and the auxiliary stack carrier is moved out of the stack area by using a drive.

A particularly advantageous feature of the invention is that a non-stop stack change is improved inasmuch as it may reliably be carried out without manual intervention. A particularly advantageous further feature of the invention is that in addition to a drive, a jolting unit is provided to cause a temporary fast acceleration of the auxiliary stack carrier. In this process, the mass inertia of the sheets in the auxiliary stack and in the main stack is greater than the forces created by frictional forces that act on the lowermost sheet in the auxiliary stack and the uppermost sheet in the main stack. Due to this measure, after the abrupt initial movement, the auxiliary stack carrier may be moved continuously out of the stack area at a constant speed.

In accordance with a first exemplary embodiment, the jolting unit includes a mass that is pneumatically movable against a stop, causing the auxiliary stack carrier, which is preferably embodied as a rake, to experience a temporary acceleration prior to being continuously withdrawn from the stack area.

In accordance with a second exemplary embodiment, the jolting unit includes a rotary drive for a spring-loaded mass that rolls on a control contour or profile with steep inclines, for instance a toothing. Due to this measure, when the stack carrier is withdrawn from the stack area, acceleration jumps are consistently imparted to the auxiliary stack carrier as it is being withdrawn from the stack area while experiencing recurring bouts of acceleration.

Other features which are considered as characteristic for the invention are set forth in the appended claims.

Although the invention is illustrated and described herein as embodied in a method and a device for combining an auxiliary stack and a main stack and a sheet-fed printing press or sheet punching machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
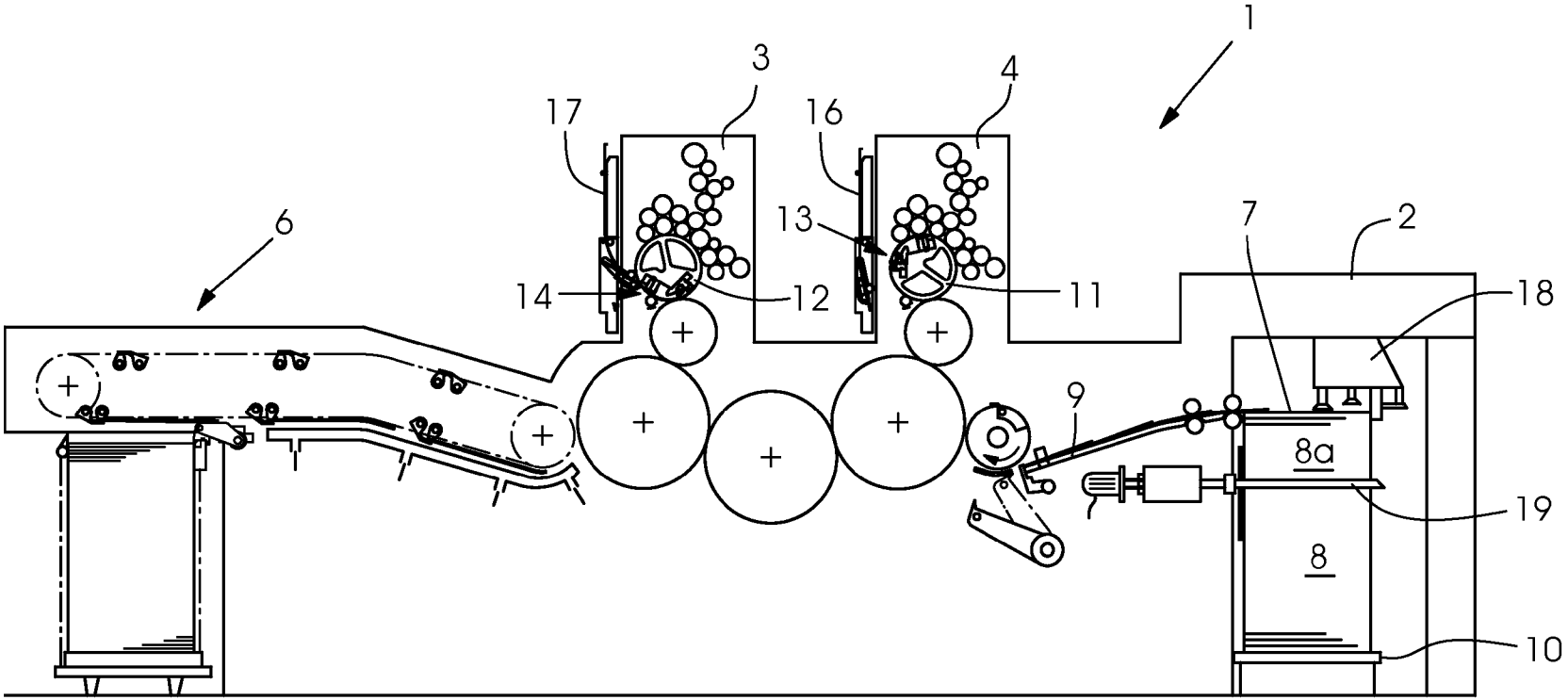
FIG. 1 is a diagrammatic, longitudinal-sectional view of a printing press.

Referring now to the figures of the drawings in detail and first, particularly, to FIG. 1 thereof, there is seen a machine, for instance a die-cutting machine or a printing press 1 for processing sheets 7, which includes a feeder 2 and a delivery 6. In the case of a printing press 1, sheets 7 are taken from a sheet stack 8 present in the feeder 2 and are fed either individually or in shingled formation over a feed table 9 to printing units 3 and 4 present in the press 1. As is known in the art, each one of the printing units 3, 4 includes a plate cylinder 11, 12, and each one of the plate cylinders 11, 12 has a device 13, 14 for mounting flexible printing plates. In addition, a respective device 16, 17 for changing plates in a semi-automated or fully automated way is associated with each one of the plate cylinders 11, 12.

The sheet stack 8 rests on a main stack plate 10, which may be lifted in a controlled way. A so-called suction head 18 which, among other elements, includes at least one suction gripper for separating the sheets 7, pulls the sheets 7 off the top of the sheet stack 8. In addition, blowing devices for loosening the upper layers of sheets and sensing elements for lifting the stack as needed are provided. At least one leading-edge stop 23 is provided to align the sheet stack 8.

Figure 2:
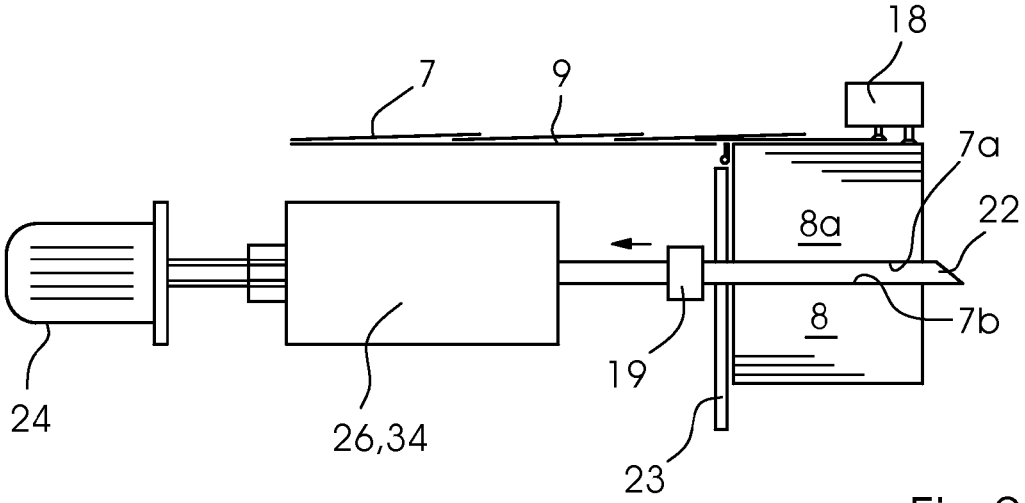
FIG. 2 is an enlarged, longitudinal-sectional view of an auxiliary stack carrier including a jolting unit.
Figure 3:
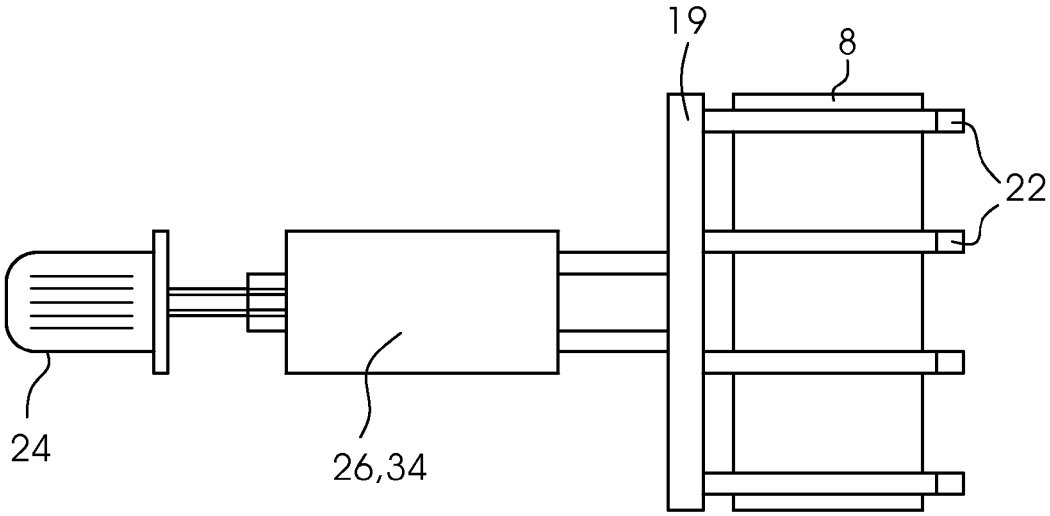
FIG. 3 is an elevational view of the auxiliary stack carrier.

As is best seen in FIGS. 2 and 3, the feeder 2 has a device for non-stop operation, i.e. a device that allows sheets 7 to be continuously conveyed even while a stack change is taking place. For this purpose, an auxiliary stack carrier 19, for instance in the form of a rake, is provided. The auxiliary stack carrier 19 supports an almost-empty sheet stack (auxiliary stack) 8*a* for as long as it takes to position a new main stack 8 in the feeder 2. The rake 19 preferably has a number of rake prongs 22 disposed next to one another and at a distance from each other. When the auxiliary stack 8*a* and the new main stack 8 are combined or merged, the auxiliary stack carrier 19 is pulled out of the stack area, preferably in the processing direction of the sheets, by using a drive 24 controllable by a control unit of the machine for processing sheets. A jolting unit 26, 34 is provided between the drive 24 and the auxiliary stack carrier 19 which is preferably embodied as a rake.

Figure 4:
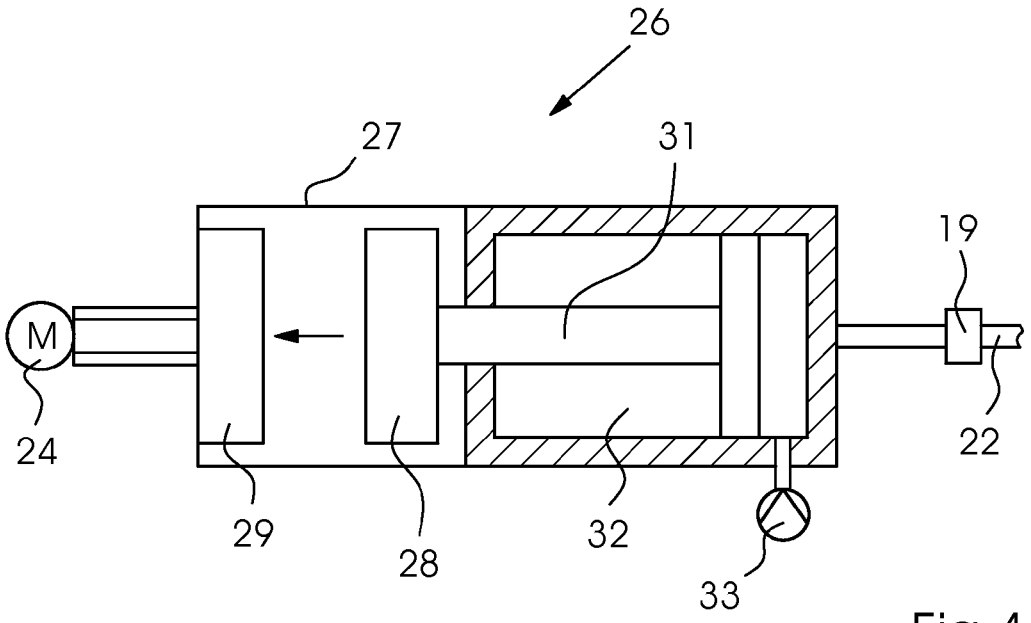
FIG. 4 is a longitudinal-sectional view of the jolting unit including a pneumatic drive.

In the exemplary embodiment shown in FIG. 4, the jolting unit 26 generates sudden movement by an abrupt jolt that causes the rake 19 to experience a brief acceleration and thus to separate from a lowermost sheet 7*a* in the auxiliary stack 8*a* and from a top sheet 7*b* of the main stack 8. Subsequently, the rake 19 is pulled out of the stack area at a constant speed v.

Figure 6:
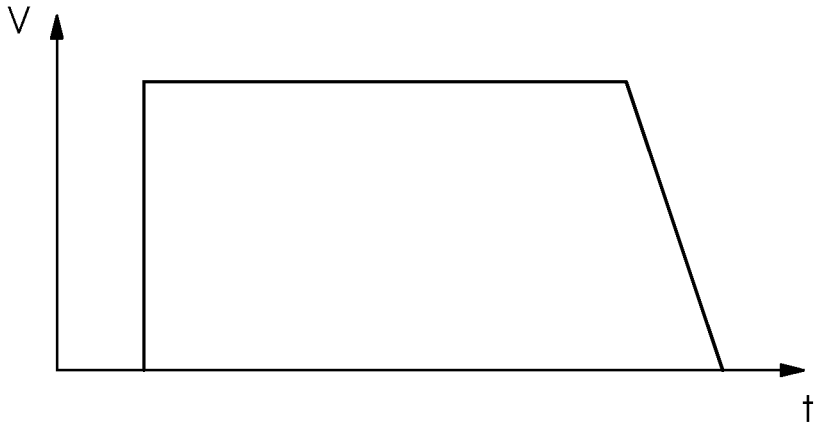
FIG. 6 is a motion diagram of the pneumatic jolting unit.

The jolting unit 26 has a housing 27 in which a mass 28 is disposed for movement against a stop 29 of the housing 27 at a high speed. The mass 28 is fitted on an end of a piston rod 31 of a pneumatic cylinder 32, to which compressed air can be supplied from a compressed air source 33. Due to this measure, the rake 19 experiences a great initial acceleration before it is pulled out of the stack area at a constant speed v as shown in the motion diagram of FIG. 6.

Figure 5:
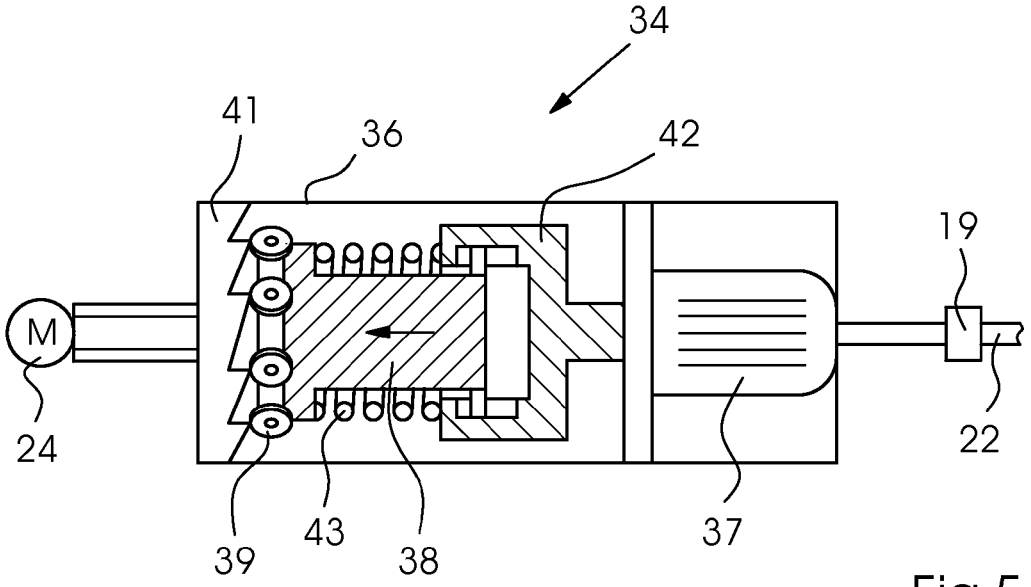
FIG. 5 is a longitudinal-sectional view of a jolting unit including an electromechanical drive.
Figure 7:
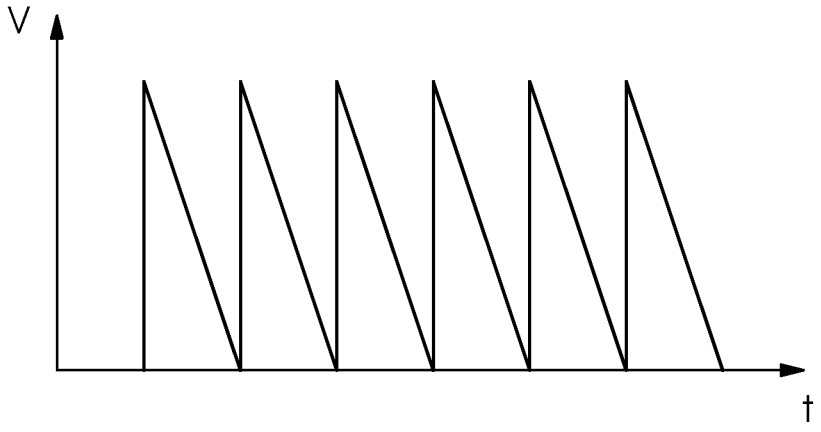
FIG. 7 is a motion diagram of the electromechanical jolting unit.

The exemplary embodiment shown in FIG. 5 includes an electromechanically actuatable jolting unit 34 including a housing 36 with a rotary drive 37 for a mass 38. The mass 38 is embodied to have a cylindrical shape and includes rollers 39 that are circumferentially distributed on an end face and roll on a profile 41, preferably a toothing (such as a saw toothing), which is disposed in a circular shape. The mass 38 is driven to rotate by an entrainment element 42 and is pressed against the profile 41 by a pre-loaded spring 43. Due to this measure, jolts are created that lead to a repeated accelerated movement of the rake 19 as the rake 19 is pulled out of the stack area as shown in the motion diagram of FIG. 7.

The invention claimed is:

1. A device for combining an auxiliary stack with a main stack in a stack area, the device comprising:

an auxiliary stack carrier supporting the auxiliary stack;

a drive pulling said auxiliary stack carrier out of the stack area; and a jolting unit abruptly accelerating the pulling of said auxiliary stack carrier out of the stack area.

2. The device according to claim 1, wherein said auxiliary stack carrier is a rake having a plurality of rake prongs disposed adjacent one another and spaced apart from one another.

3. The device according to claim 1, wherein said jolting unit includes a stop and a mass being movable against said stop.

4. The device according to claim 3, wherein said mass is pneumatically drivable.

5. The device according to claim 1, wherein said jolting unit includes a profile disposed in a circular shape and a mass being drivable to rotate and to roll under a pre-load on said profile.

6. The device according to claim 5, which further comprises a drive motor rotating said mass.

7. The device according to claim 1, wherein said jolting unit has a housing and is disposed between said drive for said auxiliary stack carrier and said auxiliary stack carrier.

8. A sheet-fed printing press or sheet-fed die-cutting or stamping machine, comprising a device according to claim 1.

9. A method for driving an auxiliary stack carrier as the auxiliary stack carrier is pulled out of a stack area to combine an auxiliary stack and a main stack, the method comprising the following steps:

imparting a jolt to the auxiliary stack carrier by using a pneumatically drivable jolting unit;

abruptly accelerating the auxiliary stack carrier due to the jolt; and subsequently moving the auxiliary stack carrier out of the stack area at a constant speed by using a drive.

10. A method for driving an auxiliary stack carrier as the auxiliary stack carrier is pulled out of a stack area to combine an auxiliary stack and a main stack, the method comprising the following steps:

imparting successive sudden movements to the auxiliary stack carrier at regular intervals by using an electro-mechanically drivable jolting unit;

accelerating the auxiliary stack carrier in a jerky manner due to the sudden movements as the auxiliary stack carrier is being pulled out of the stack area; and moving the auxiliary stack carrier out of the stack area by using a drive.

* * * * *